United States Patent [19]

Kusaka et al.

[11] Patent Number: 4,658,799

[45] Date of Patent: Apr. 21, 1987

[54] IGNITION COIL ASSEMBLY FOR INTERNAL COMBUSTION ENGINES

[75] Inventors: Yoshimi Kusaka; Takashi Yoshinari, both of Katsuta; Hiroshi Watanabe, Takahagi, all of Japan

[73] Assignee: Hitachi, Ltd., Tokyo, Japan

[21] Appl. No.: 840,199

[22] Filed: Mar. 17, 1986

[30] Foreign Application Priority Data

Mar. 25, 1985 [JP] Japan ..... 60-58443

[51] Int. Cl.[4] ..... F02P 1/00

[52] U.S. Cl. ..... 123/622; 123/634; 336/96; 336/214; 336/234

[58] Field of Search ..... 123/621, 622, 634, 643; 336/96, 212, 214, 234

[56] References Cited

U.S. PATENT DOCUMENTS 4,509,495 4/1985 Betz et al. ..... 123/643
4,599,985 7/1986 Betz ..... 123/634 X

FOREIGN PATENT DOCUMENTS 75962 6/1981 Japan .
44707 3/1983 Japan .

*Primary Examiner*—Tony M. Argenbright
*Attorney, Agent, or Firm*—Antonelli, Terry & Wands

[57] ABSTRACT

For a four cylinder engine, there are provided two ignition coil units, each including a primary coil and a secondary coil. The primary coil is wound around a center core made of grain oriented silicon steel, which forms a closed magnetic path for the magnetic flux produced by the coil unit together with a side core formed of non-grain oriented steel as one body. In the closed magnetic path there is provided an air gap. The current of the primary coils is controlled by transistors operated in response to gate signals furnished from an ignition control unit. The transistors are provided with a diode in the reverse parallel therewith. With these arrangements, the ignition coil assembly for an electronic distribution system can be miniaturized with the unfavorable influence of the magnetic interference suppressed remarkably.

5 Claims, 6 Drawing Figures

IGNITION COIL ASSEMBLY FOR INTERNAL COMBUSTION ENGINES

BACKGROUND OF THE INVENTION

1. Field of the Invention

The present invention relates to an ignition coil assembly for an internal combustion engine, and particularly to an ignition coil assembly suited for an electronic distribution type ignition in a multicylinder internal combustion engine.

2. Description of the Related Art

Recently it is brought into practice to execute the ignition of a multicylinder engine without providing a mechanical distributor which has been popularly used. In such an ignition system, an electronic distribution function is substituted for a conventional rotating distribution mechanism. Therefore, such a system is called an electronic distribution system, for the convenience of the following explanation.

According to a typical one of the electronic distribution system, as disclosed in Japanese Patent Laid-open No. 58-44707, for example, an ignition coil assembly having two primary coils wound reversely to each other in the winding direction and a secondary coil magnetically coupled with the primary ones is employed for ignition in a four cylinder engine. Usually, these coils are integrated and molded by an appropriate synthetic resin as disclosed in Japanese Patent Laid-open No. 56-75962, for example.

The two primary coils are alternately supplied with a current through power transistors which are connected with the respective primary coils and alternately rendered conductive by gate signals from an ignition control unit. As a result, the current flowing through one primary coil becomes an intermittent current. Every time the current flowing through the primary coils is interrupted, the high voltage is induced across terminals of the secondary coil. Because both the primary coils have the different winding direction from each other, the polarity of the high voltage induced in the secondary coil upon interruption of the current flowing through one of the primary coils is opposite to that of the voltage induced upon interruption of the current in the other primary coil. Namely, when the current of one of the primary coils is cut off, the high voltage is induced so as to be positive at one of the terminals of the secondary coil, and when the current of the other primary coil is cut off, it is induced so as to be positive at the other terminal thereof.

To each terminal of the secondary coil are connected two diodes which are in the opposite direction. Usually, these diodes are also molded in one body together with the coil portion. A cathode of a first diode and an anode of a second diode are connected commonly to one of the terminals of the secondary coil and similarly a cathode of a third diode and an anode of a fourth diode to the other terminal thereof. The remaining electrodes of every diodes are led to respective spark plugs.

With the above mentioned arrangement, the high voltage produced in the ignition coil unit is distributed to the four cylinders. In this case, it is to be noted that a spark discharge occurs in two cylinders simultaneously every generation of the high voltage in the secondary coil. However, if the direction of the diodes and the relation of the spark plugs connected thereto are properly selected, the spark discharge taken place in either one of the two cylinders can be rendered inoperative.

In the electronic distribution system as described above, diodes have to provided on the high voltage side of the ignition coil unit. Usually, an ignition coil unit is required to produce the voltage of more than 30 kV in order to secure a good performance of engines. Diodes used in such high voltage are considerably expensive. On the other hand, the cost of the coil portion has been extremely reduced by adopting a wide variety of manufacturing techniques. Therefore, the use of such expensive high voltage diodes contributes to raising the total cost of the ignition coil unit to a great extent and brings the every effort in the cost reduction of the electronic distribution system to naught.

In order to realize the inexpensive electronic distribution system, it has been considered to employ two separate ignition coil units. Although, since the coil portion itself is not costly, an assembly of such ignition coil units can be realized economically, the size thereof becomes considerably large and the problem occurs in its installation at an engine. To the contrary, if plural coil units are compactly assembled to be placed closely for the purpose of avoiding such a problem in the installation, the magnetic interference happens among the coil units to invite the miss in the ignition.

SUMMARY OF THE INVENTION

An object of the present invention is to provide an improved ignition coil assembly for an internal combustion engine having a plurality of coil units each of which includes a primary coil supplied with a primary current from a battery and a secondary coil magnetically coupled with the primary coil, both ends of which are respectively connected to spark plugs, center cores around which the respective coil units are provided, a side core magnetically linked with the center cores to form closed magnetic paths for the magnetic fluxes produced by the respective primary coils, and switching means for controlling the primary currents supplied for the respective primary coils in response to ignition signals furnished by an ignition control unit.

A feature of the present invention is in that each of the center cores is made of grain oriented silicon steel plates and the side core is formed of non-grain oriented silicon steel plates as one body. Further, an air gap is provided in a part of each of the closed magnetic pathes formed by the center cores and the side core. There is another feature of the present invention in that each of the primary coils is provided with means for flowing a current therethrough which is caused by the voltage induced in the primary coil when the primary current of any other coil units is interrupted.

According to the present invention, the size of each coil unit can be considerably reduced by making the center core placed within the coil unit of the grain oriented silicon steel plates with a high magnetic flux density. This contributes the reduction of the size of the ignition coil assembly as a whole to a great extent. Further, the side core with low magnetic reluctance can be realized economically by forming it with the non-grain oriented silicon steel plates as one body. The unfavorable influence of a magnetic interference caused by assembling plural coil units compactly can be remarkably avoided and suppressed by the air gap formed in a part of the closed magnetic path and the current flowing means provided to the respective primary coil.

DESCRIPTION OF THE PREFERRED EMBODIMENTS

Figure 1:
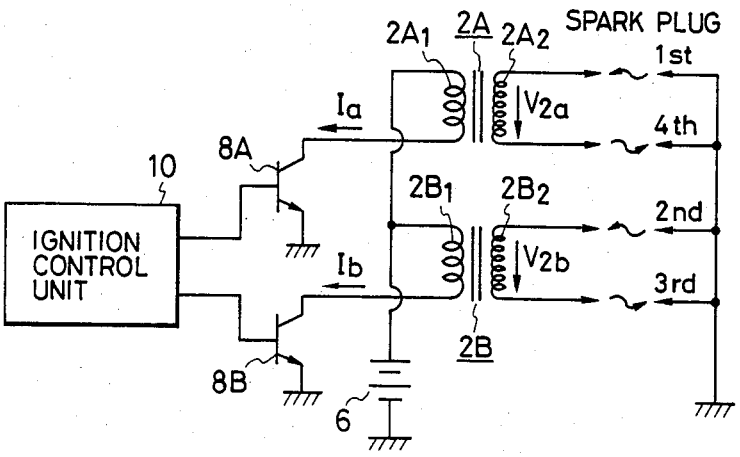
FIG. 1 PRIOR ART
FIG. 1 is an explanatory drawing schematically showing an example of an electronic distribution system to which the present invention is applied.

Preceding to the detailed explanation of an embodiment of the present invention, the description is made of an electronic distribution system of the type to which the present invention is applied, referring to FIG. 1. Further, this figure shows an example in which such a system is applied to a four cylinder engine.

In such a system, as shown in the figure, there are provided two separate ignition coil units 2A and 2B. These coil units 2A, 2B have primary coils $2A_1$ and $2B_1$ and secondary coils $2A_2$ and $2B_2$, respectively. One ends of the primary coils $2A_1$, $2B_1$ are connected in common to one of terminals of a battery 6 the other terminal of which is grounded.

The other ends of the primary coils $2A_1$, $2B_1$ are connected to power transistors 8A and 8B, respectively. The transistors 8A, 8B are supplied with gate signals from an ignition control unit 10. Both ends of the secondary coils $2A_2$, $2B_2$ are directly led to four spark plugs, which are provided in the corresponding cylinders. In the case shown, both the ends of the secondary coil $2A_2$ are connected to one ends of a first and a fourth spark plugs, respectively and those of the secondary coil $2B_2$ to one ends of a second and a third spark plugs, respectively. The other ends of all the spark plugs are grounded.

The control unit 10 takes thereinto a crank angle signal, an airflow signal, a cooling water temperature signal and so on from respective sensors and determines an ignition timing and a primary current flowing duration in accordance with those signals. Further, an ignition signal is produced on the basis of the determined timing and duration. The thus produced ignition signal is divided and distributed into two signals in accordance with the crank angle signal. These distributed signals are led to the transistors 8A and 8B as a gate signal, respectively.

In the case of the four cylinder engine, one of the gate signals is a pulse signal having the pulse interval of 180° in the crank angle, the pulse width of which depends on the aforesaid ignition signal. The other gate signal is also the same pulse signal, but it has the phase difference of 180° in the crank angle from the former gate signal. The functions as mentioned above are usually included in a known electronic engine control appartus. In the figure, the functions of generation of the ignition signal and distribution thereof are extracted from among those included in such an electronic control apparatus and indicated as a discrete unit Therefore, the further description is omitted here.

With the above mentioned arrangement, if the transistor 8A is made conductive, the current as shown by $I_a$ flows through the primary coil $2A_1$. When the current $I_a$ is cut off at a certain crank angle, the high voltage $V_{2a}$ is produced across the terminals of the secondary coil $2A_2$, so that the discharge occurs at the first and fourth spark plugs, i.e. in the first and fourth cylinders simultaneously, as shown by waved arrows in the figure. If, however, the first cylinder is in a compression stroke at the certain crank angle and the fourth cylinder is in an exhaust stroke, only the discharge at the first spark plug takes effect and the first cylinder goes into an explosion stroke. At the crank angle of 360° later from the above mentioned ignition, the discharge simultaneously takes place at the first and fourth spark plugs again. At this time, however, the first cylinder is in the exhaust stroke while the fourth cylinder is in the compression stroke, Therefore, only the ignition in the fourth cylinder is operative this time.

The same operation as described above is done with respect to the second and third spark plugs, i.e. the second and third cylinders, with the phase difference of 180° in the crank angle from that in the first and fourth cylinders. By repeating these operations, the electronic distribution can be achieved. As is seen in the figure, however, a couple of the separate ignition coil units are required in the case of a four cylinder engine. Generally speaking, the number of the required ignition coil units is equal to half of the number of cylinders of an engine.

Figure 2:
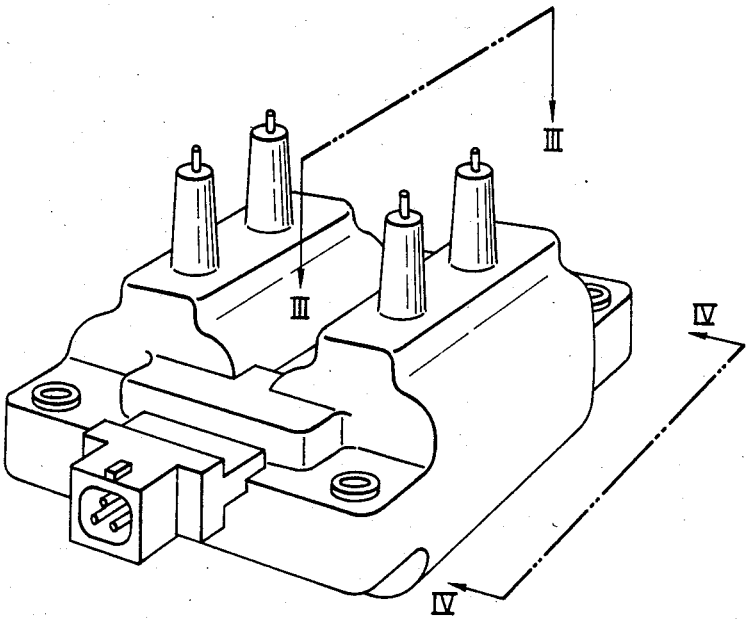
FIG. 2 is a sketch illustrating a general view of an ignition coil assembly according to an embodiment of the present invention.
Figure 3:
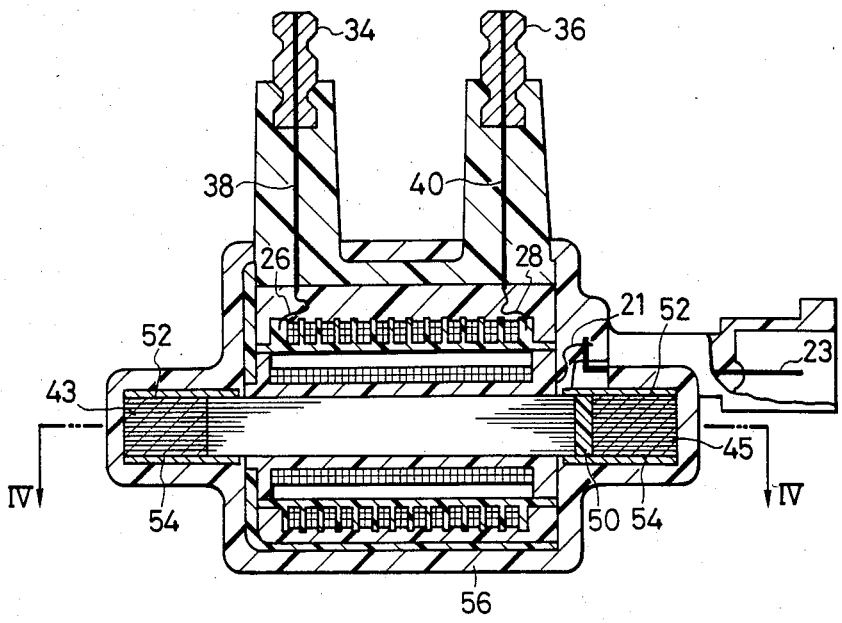
FIG. 3 is a diagram showing a view of a vertical section of the ignition coil assembly along with a line III—III shown in FIG. 2.
Figure 4:
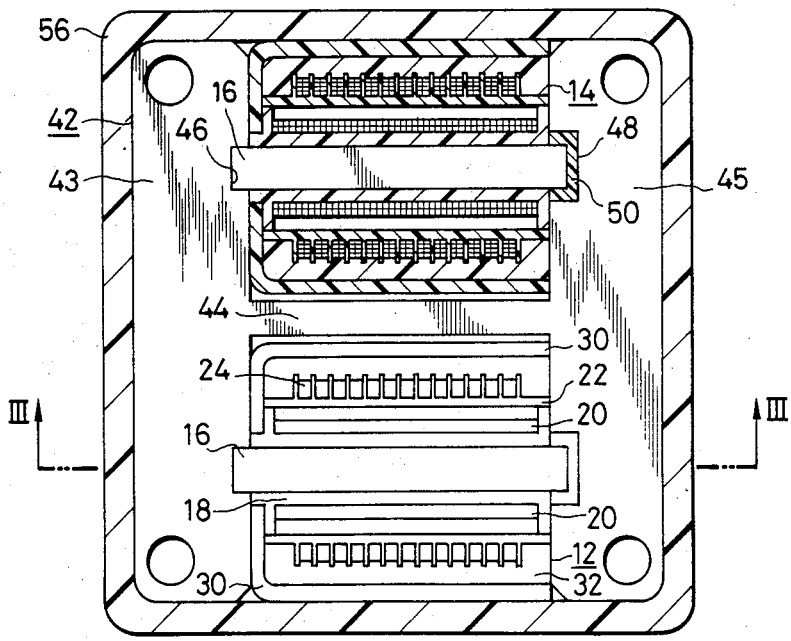
FIG. 4 is a diagram showing a horizontal sectional view of the ignition coil assembly along with a line IV—IV shown in FIG. 2.

Now, an ignition coil assembly according to an embodiment of the present invention is generally sketched in FIG. 2. The ignition coil assembly shown is for use in a four cylinder engine. The detailed description will be made of the structure of this ignition coil assembly, referring to FIGS. 3 to 5.

As is apparent from the figures, the ignition coil assembly comprises two coil units 12 and 14 which have quite the same structure. Therefore, the following description is done of the structure of the coil unit 12 only. Further in FIG. 4, only the section of the coil unit 14 is hatched in order to facilitate to understand the difference in the material, but the hatching of the section of the coil unit 12 is omitted so as to clearly identify reference numerals of every members.

The coil unit 12 has a primary bobbin 18 with a through hole in the direction of its axis, which is made of a thermoplastic resin such as polybutylene terphthalate including fiberglass. The sectional shape of the through hole is made rectangular so as to hold a center core 16 as described in detail later fixedly therein. The bobbin 18 is provided with flanges in both end portions. Around the bobbin 18, there is provided a primary coil 20 between the flanges, which can be formed by winding with a total 100 to 300 turns of an enameled wire of a diameter of 0.2 to 1.0 mm in such a manner that several winding layers are formed on the bobbin 18, each layer having several ten turns. The primary coil used in the inventors' experiment has been formed of an enameled wire of the diameter of 0.55 mm and wound about total 120 turns. These specifications of the primary coil are determined in accordance with the required starting characteristic of an engine. End leads 21 of the primary coil 20 are connected to connecting terminals 23 which provide the electric connection with an external circuit.

The thus formed primary coil 20 is inserted into a through hole of a secondary bobbin 22, which is made of a thermoplastic resin such as modified polyphenylene oxide including fiberglass. The primary coil 20 is so placed that the flanges of the bobbin 18 are fitted in the through hole of the bobbin 22. On the outer surface of the secondary bobbin 22 there are provided a plurality of collars, and winding grooves are defined by pairs of collars which are adjacent to each other. Such a bobbin is known as a segmented bobbin. In the case of this embodiment, thirteen grooves are formed by fourteen collars. In every grooves of the segmented bobin 22, the windings of a secondary coil 24 are wounded and all connected in the series. Usually, the secondary coil 24 can be formed by winding with the total 5,000 to 10,000 turns of an enameled wire of a diameter 0.03 to 0.1 mm in such a manner that the whole winding of the secondary coil is divided into 3 to 15 segments connected in series. The secondary coil used in the inventor's experiment has been formed of the total 9,760 turns of an enameled wire of the diameter of 0.048 mm, which is divided into 13 segments. Both ends of the coil segments connected in series are derived as output leads 26, 28 of the secondary coil 24.

The thus integrated primary and secondary coils are accomodated in a casing 30 made of a thermoplastic resin. The space between the secondary coil 24 and the casing 30 is filled with an insulating thermosetting mold resin 32 by a vacuum injection whereby the sufficient insulation against the high voltage produced in the winding of the secondary coil 24 can be secured. Further, the output leads 26 and 28 are connected to high voltage terminals 34 and 36 through lead rods 38 and 40, respectively. These rods and terminals are also molded by a thermoplastic resin such as polybutylene terephthalate. In this way, the coil units 12, 14 are constructed.

The center core 16 is formed by laminating rectangular punched strips of a grain oriented silicon steel plate (for example, Z7H manufactured by Nippon Steel Corporation, thickness 0.3 mm). Further, it is to be noted that the direction in which the magnetic flux easily passes through the center core 16, i.e. an axis of easy magnetization of the center core, is coincident with the direction of the magnetic flux produced by the primary coil 20. The sectional shaped of the laminated center core 16 which was used in the inventors' experiment has been a square of 12.5×12.5 (mm), which is slightly smaller than that of the through hole of the primary bobbin 18, so that the center core 16 is smoothly but fixedly inserted thereinto. The length of the center core 16 is somewhat longer than that of the core unit 12 in its axial direction, so that when the center core 16 is inserted into the through hole of the primary bobbin 18, end portions of the center core 16 are projected to the small amount from both sides of the coil unit 12.

On the other hand, a side core 42 is a laminated core made of non-grain oriented silicon steel plates (for example, S12 by the same manufacturer, thickness 0.35 mm). The side core 42 has a H-shaped structure which is composed of two side portions 43, 45 and a center portion 44 bridging the side portions 43, 45. The insides of the side portions 43, 45, i.e. the side opposing to each other, of the H-shaped side core 42 are provided with notches 46, 48. The notch 46 provided in a left-hand side portion 43 is so large as to be able to fit the end of the center core 16 therein, and the notch 48 in a right-hand side portion 45 is somewhat larger than the former notch 46 so that an air gap is formed between the other end of the center core 16 and the right-hand side portion 45. A spacer 50 of non-magnetic material such as paper or synthetic resin is stuffed into the respective air gaps for fixing the center core 16.

Further, the side core 42 is H-shaped in this embodiment, because the two coil units 12, 14 are used. More generally, however, the side core may be of the ladder-shape which is formed with two side portions and at least one rung portion bridging the two side portions. In this case, the coil units are placed in spaces which are defined by the side and rung portions.

Figure 5:
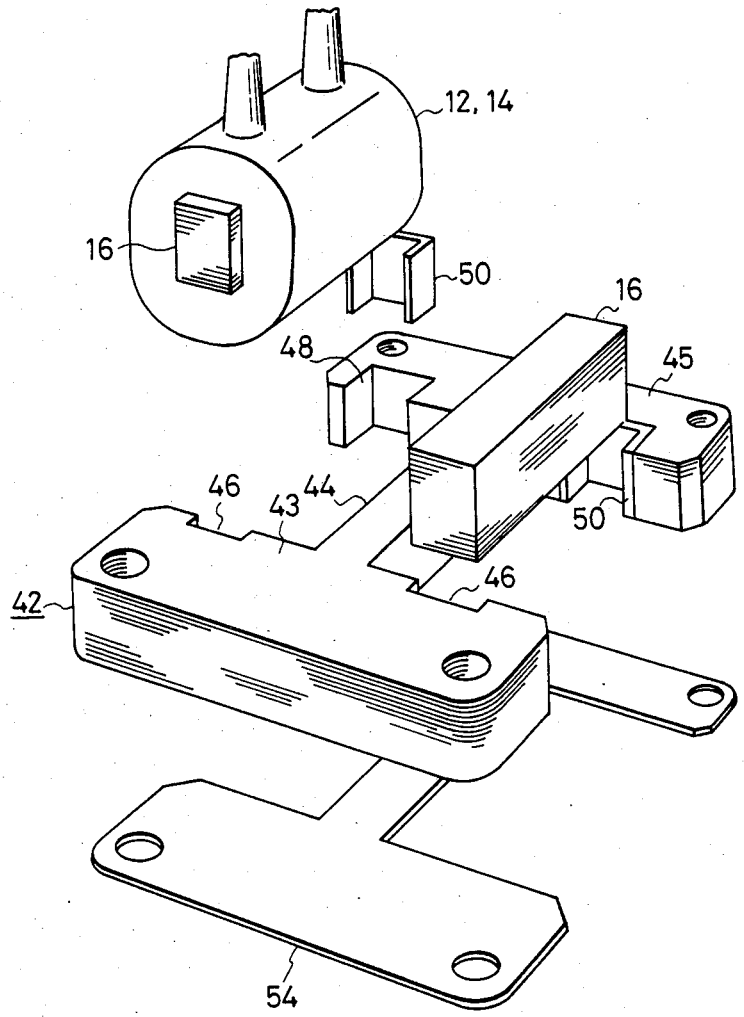
FIG. 5 illustrates an exploded view of a core portion of the ignition coil assembly shown in FIG. 2.

After the center cores 16 provided with the coil units 12, 14 are so assembled that the projected ends thereof are fitted into the notches 46, 48, H-shaped backing plates 52, 54 made of non-magnetic material are put on the side core 42 from both upper and lower sides. Since the backing plates 52, 54 have no notches in the portions corresponding to the notches 46, 48 of the side core 42, the side portions of the H-shaped backing plates 52, 54 hold down the porjected ends of the center cores 16 so that the coil units 12, 14 are prevented from fluctuating up and down. The assembling procedure as mentioned above will be easily understood from referring to FIG. 5 showing an exploded view of the core portion of the assembly, wherein, however, one of the center cores 16 is shown without being provded with the coil unit and the upper backing plate 52 is omitted, for the convenience of simple illustration.

In the above mentioned embodiment, the grain oriented silicon steel plate used for the center core 16 usually has the maximum flux density of 1.3 times that of the non-grain oriented silicon steel plate. Therefore, the number of turns of a coil wound on a core made of such a steel plate can be reduced down to about 70% of that of a coil wound on a core made of the non-grain oriented silicon steel, if both cores have the same sectional area. Conversely speaking, when the number of turns of the coil wound on the former core is made equal to that in the latter core, it will be possible to obtain the same secondary voltage, even if the sectional area of the former core is reduced down to about 70%. Accordingly, such an arrangement makes it possible to realize a miniaturized and light weight ignition coil assembly, which is capable of securing the favorable performance.

Further, in the above mentioned embodiment, the side core 42 is made as one body of the non-grain oriented silicon steel plate. If only a viewpoint of the magnetic flux density is taken into account, it will be considered to form the side core 42 of the grain oriented silicon steel plate. In this case, however, it should be noted that the directions of the magnetic flux produced by the primary coil 20 are different to each other in the side portions 43, 45 of the side core 42 and in the center portion 44 thereof which is commonly used for magnetic paths for the coil units 12 and 14. The direction of the magnetic flux passing through the center portion 44 is just opposite to that of the magnetic flux passing through the center cores 16, while the direction of the magnetic flux in the side portions 43, 45 is at a right angle to that of the magnetic flux in the center portion 44. In case a side core for such magnetic fluxes is made of the grain oriented silicon steel plate, it can not be formed as one body. In this case, the side core must be formed by dividing it into a few parts, at least three parts, i.e. two parts for the side portion 43, 45 and a part for the center portion 44. These core parts are so combined to form the side core that the direction in which the magnetic flux easily passes through a core part, i.e. an axis of easy magnetization of each core part, is in coincidence with the direction of the magnetic flux in the portion in which the core part is used. Such an arrangement is the considerably complicated structure, resulting in the complex manufacturing process and hence the raise in cost.

With the above mentioned structure, the ignition coil assembly can be miniaturized without causing any addition cast. By the way, it is well known that when plural coils are placed closely, the mutual magnetic interference occurs thereamong. In the above described embodiment, because the magnetic paths for the two coil units are formed in one body with a part thereof (i.e. the center portion of the side core) used commonly, the magnetic interference is very easy to occur. Namely, when the current of a primary coil of one of the coil units is cut off, the undesirable high voltage can be induced in a secondary coil of the other coil unit which should not produce any voltage at that time. This fact will be explained more in detail, referring to FIG. 6.

Figure 6:
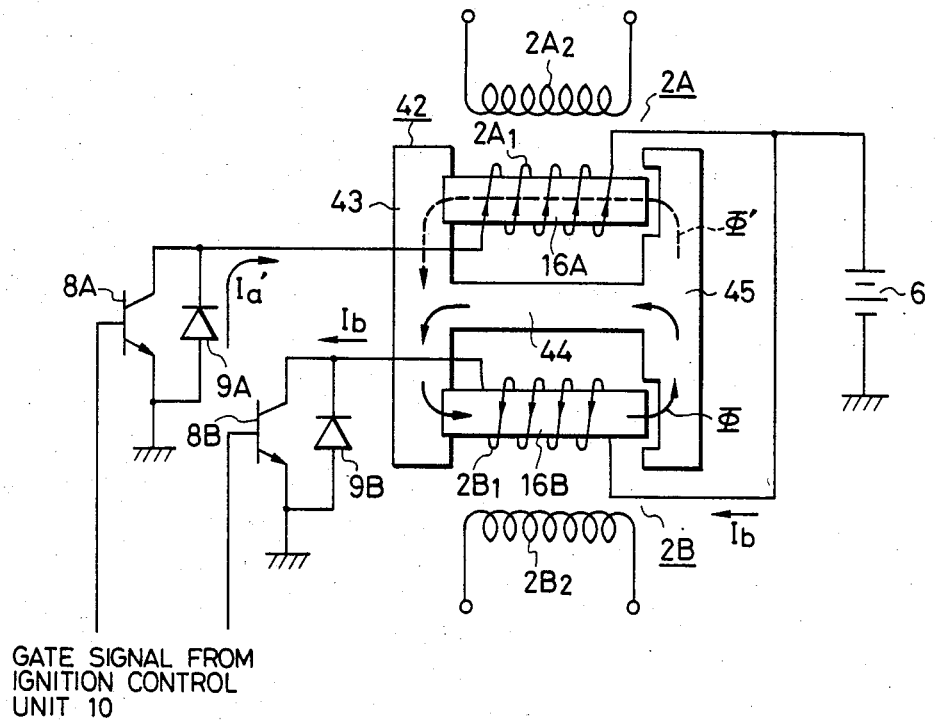
FIG. 6 schematically shows the embodiment of the present invention which includes a driving circuit as well as the ignitin coil assembly as shown in FIG. 2.

FIG. 6 shows the embodiment of the present invention which includes a driving circuit formed of power transistors as well as the ignition coil assembly as described above. In the figure, like reference numerals or characters indicate like parts which have been shown in the previous drawings. The remaining references will be referred to in the following description of the function or operation made with reference to this figure. Further, alathough the windings of the secondary coil $2A_2$, $2B_2$ are drawn outside center cores 16A, 16B respectively, this is only for the convenience of simple and clear illustration.

In the arrangement shown, the windings of the primary coils $2A_1$ and $2B_1$ are the same in their winding direction. Further the beginning ends (or the terminal ends) of both the windings are connected in common to the battery 6, and the terminal ends (or the beginning ends) thereof are connected with the power transistors 8A and 8B respectively. Therefore, it can be said that both the coils $2A_1$ and $2B_1$ are so formed that a main magnetic flux produced by the respective primary currents have the same direction in the corresponding center cores 16A and 16B, namely in a case shown, they are in the direction from left to right. In vew of the closed magnetic path, however, they are opposite to each other. Namely, if the main magnetic flux by the coil $2B_1$ flows through the magnetic path counterclockwise, as shown in the figure, that by the coil $2A_1$ flows therethrough clockwise, and vice versa.

Now, when the transistor 8B is rendered conductive by a gate signal from the ignition control unit 10, for example, the curren $I_b$ flows through the primary coil $2B_1$ and the main magnetic flux $\Phi$ is generated in the center core 16B, as shown in the figure. At this time, some quantity of a magnetic flux $\Phi'$ is induced in the center core 16A by a leakage magnetic field. Under such conditions, when the current $I_b$ is interrupted, the main magnetic flux $\Phi$ changes rapidly so that the high voltage is induced in the secondary coil $2B_2$. This high voltage causes the spark discharge at the second and third spark plugs connected to both ends of the secondary coil $2B_2$. This is a regular spark discharge, because either one of the second and third cylinders ought to be in the compression stroke at that time.

Simultaneously therewith, however, the magnetic flux $\Phi'$ also changes rapidly and the irregular and undesirable voltage is induced the secondary coil $2A_2$. This voltage is applied to the first and fourth spark plugs. At this time, if the first cylinder is in the explosion stroke, the fourth one is in the suction stroke, and vice versa. As a result, in one of the cylinders which is in the suction stroke, the irregular explosion is caused by the voltage induced in the coil $2A_2$.

Therefore, the quantity of the magnetic flux $\Phi'$ must be reduced as much as possible. For this purpose, there is provided an air gap 50A in the path of the magnetic flux $\Phi'$ caused by the leakage. The air gap 50A functions as a magnetic reluctance against the magnetic flux passing therethrough, so that the quantity of the magnetic flux $\Phi'$ is remarkably reduced. The same is applied to the case where the current flowing through the primary coil $2A_1$ is cut off. In order to prevent the secondary coil $2B_2$ from inducing the irregular and undesirable voltage, an air gap 50B is provided between the center core 16B and side portion 45 of the side core 42.

With the core structure as mentioned above, it is possible to considerably reduce the unfavorable influence on the ignition resulted from the magnetic interference. Further it is much improved by adopting necessary measures in the primary coil. As such necessary measures, in this embodiment, there are provided diodes 9A and 9B in reverse parallel with the power transistors 8A and 8B respectively, as shown in FIG. 6. The reason therefor is as follows. As already described, when the current $I_b$ is interrupted, the magnetic flux $\Phi'$ tends to decrease. At this time, however, a voltage is induced in the coil $2A_1$ in such a direction that the change of the magnetic flux $\Phi'$ is disturbed. This voltage causes a current $I_a'$ flowing through the primary coil $2A_1$ and the diode 9A so that the magnetic flux $\Phi'$ is suppressed to change. As a result, the high voltage is scarcely induced in the secondary coil $2A_2$. The same is true of the case where a current flowing through the coil $2A_1$ is cut off.

In the experiment conducted by the inventors, the voltage applied to a spark plug connected with a secondary coil of one (a resting coil unit) of the coil units 2A, 2B has been measured when the other coil unit (an operating coil unit) was so operated that the voltage of 36 kV as a regular spark voltage is applied to the spark plugs connected to the operating coil unit. The voltage of the battery 6 was 14 volts and the primary current of the operating coil unit was 6 amperes. According to the result of the experiment, with only the air gap in the magnetic path, the voltage applied to the spark plug connected to the resting coil unit was around 4.0 kV, which is about one fifth of that in the case of no air gap. Further, that voltage was remarkably decreased by providing the diodes 9A, 9B together with the air gaps. In the experiment, the observed voltage was so small as 0.8 kV, which is one fifth of that in the case of the provision of only the air gap and indeed one twenty-fifth of that in the ase of no air gap.

In the embodiment described above, the air gap in the magnetic path has been stuffed with a paper or a plastic resin. If, however, an appropriate magnet is so inserted into the air gap that the magnetic flux of the magnet functions as a reverse bias against the main magnetic flux produced in the center core, there is yield the effect that when the primary current of a coil unit is cut off, the changing range of the main magnetic flux is widened, so that the voltage induced in the secondary coil of the coil unit becomes higher. Since the voltage induced in the secondary coil is further hightened by a magnet as mentioned above, the less magnetic flux density in the center core can induce the sufficiently high voltage across the secondary coil. This fact means that the coil unit can be further miniaturized.

As described heretofore, according to the present invention, an ignition coil assembly including a plurality of coil units can be realized in the sufficiently miniaturized form. Further, the influence of the magnetic interference which is inherently accompanied by the miniaturization can be avoided to a great extent, so that the good performance is provided by a small-sized ignition coil assembly.

What is claimed is:

1. An ignition coil assembly for an internal combustion engine having a plurality of coil units each of which includes a primary coil supplied with a primary current from a battery and a secondary coil magnetically coupled with the primary coil, both ends of which are connected to respective spark plugs, center cores around which the respective coil units are provided, a side core magnetically linked with the center cores to form closed magnetic paths for the magnetic fluxes produced by the respective primary coils, and switching means for controlling the primary currents supplied for the respective primary coils in response to ignition signals furnished by an ignition control unit, characterized in that each of said center cores is a laminated core formed of grain oriented silicon steel plates and so placed within a coil unit that an axis of easy magnetization of the center core coincides with the direction of the magnetic flux produced by the primary coil of the coil unit, that said side core is a laminated core made of non-grain oriented silicon steel plates as one body and linked magnetically with each of said center cores with an air gap in a part of the magnetic path formed by each of said center cores and said side core, and that each of said primary coils, when it is supplied with a primary current, produces the magnetic flux which is in the same direction in the center core as those produced by any other primary coils.

2. An ignition coil assembly for an internal combustion engine according to claim 1, wherein said air gap formed between each of said center cores and said side core is stuffed with a non-magnetic material.

3. An ignition coil assembly for an internal combustion engine according to claim 1, wherein a magnet is inserted into said air gap formed between each of said center cores and said side core in such a manner that the magnetic flux of said magnet functions as a reverse bias against that produced by the primary coil in the center core.

4. An ignition coil assembly for an internal combustion engine according to claim 1, wherein a primary coil of each of said coil units is provided with means for flowing a current through the primary coil which is caused by the voltage induced in the primary coil when the primary current of any other coil units is interrupted.

5. An ignition coil assembly for an internal combustion engine according to claim 1, wherein said side core has a ladder-shaped structure with two side portions and at least one rung portion bridging the two side portions and the coil units provided with the center cores are placed in spaces defined by the two side portions and the rung portion so as to define air gaps between one ends of the center cores and either one of the side portions of said side core.

* * * * *